US007413423B2

(12) United States Patent
Bonifas

(10) Patent No.: US 7,413,423 B2
(45) Date of Patent: Aug. 19, 2008

(54) COMPRESSOR HAVING A LUBRICATION SHIELD

(75) Inventor: Mark A. Bonifas, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 11/522,555

(22) Filed: Sep. 14, 2006

(65) Prior Publication Data

US 2008/0069714 A1 Mar. 20, 2008

(51) Int. Cl.
*F04C 29/02* (2006.01)
*F04C 18/04* (2006.01)

(52) U.S. Cl. ..... 418/55.6; 418/88

(58) Field of Classification Search ..... 418/55.1, 418/55.6, 88, 89, 94, 96, 99; 184/6.15, 6.16, 184/6.23

See application file for complete search history.

(56) References Cited

U.S. PATENT DOCUMENTS 2,151,565 A * 3/1939 Robinson ..... 62/469
3,560,116 A * 2/1971 Valbjorn et al. ..... 417/372
4,552,518 A * 11/1985 Utter ..... 418/55.6
4,609,334 A * 9/1986 Muir et al. ..... 418/55.2
4,895,496 A * 1/1990 Elson ..... 417/372
5,064,356 A * 11/1991 Horn ..... 417/410.5
5,593,294 A * 1/1997 Houghtby et al. ..... 418/55.1
6,056,523 A * 5/2000 Won et al. ..... 418/15
6,280,154 B1 * 8/2001 Clendenin et al. ..... 417/410.5
6,280,155 B1 * 8/2001 Dreiman ..... 417/410.5
6,585,496 B1 * 7/2003 Sun ..... 417/410.5

* cited by examiner

*Primary Examiner*—Mary A Davis
(74) *Attorney, Agent, or Firm*—Harness, Dickey & Pierce, P.L.C.

(57) ABSTRACT

A cup-shaped shield surrounds a counter weight on the lower end of a rotor of the refrigeration compressor. The shield advantageously restricts lubricant flow to the rotating lower end of the rotor whereby power consumption of the motor is reduced. The shield may be axially and/or rotationally limited by engagement with a lower bearing assembly. The shield may be used on a scroll compressor. The shield may also be used on a rotor without having a counter weight on the lower end thereof.

24 Claims, 7 Drawing Sheets

COMPRESSOR HAVING A LUBRICATION SHIELD

BACKGROUND AND SUMMARY

The present teachings relate generally to field compressors and, more specifically, to lubrication systems for compressors.

Typical refrigeration compressors incorporate a lubricant sump in the lower or bottom portion of the housing into which the drive shaft extends so as to pump lubricant therefrom to the various portions requiring lubrication. In addition, the lubricant also often acts to aid in removal of heat from the various components. In order to ensure sufficient lubricant is contained within the sump to assure adequate lubrication and/or cooling of the moving parts while also minimizing the overall height of the housing, it is sometimes necessary that the lubricant level extend above the rotating lower end of the rotor and the counter weight thereon. However, the higher viscosity of the lubricant as compared to refrigerant and gas creates an increased drag on rotation of the rotor, resulting in increased power consumption. This problem may be further aggravated in scroll-type compressors, which typically employ a counter weight secured to the lower end of the rotor.

A shield for a refrigeration compressor that advantageously limits its axial position is disclosed. A portion of the shield may engage with a bearing assembly such that axial movement of the shield member relative to the bearing assembly is limited by the engagement. A portion of the shield member may engage with the bearing assembly such that rotational movement of the shield relative to the bearing assembly is limited by the engagement. Axial and rotational movement of a shield member relative to the shell of the refrigeration compressor may be limited by engagement of the shield member with components other than the shaft. The shield member advantageously restricts lubricant flow to the rotating lower end of the rotor whereby power consumption of the motor is reduced.

Further advantages, features and areas of applicability of the present teachings will become apparent from the detailed description provided hereinafter. It should be understood that the detailed description and specific examples are intended for purposes of illustration only and are not intended to limit the scope of the claims.

BRIEF DESCRIPTION OF THE DRAWINGS

The present teachings will become more fully understood from the detailed description and the accompanying drawings, wherein.

DETAILED DESCRIPTION OF THE PREFERRED EMBODIMENTS

The following description is merely exemplary in nature and is in no way intended to limit the teachings, its application, or uses.

Figure 1:
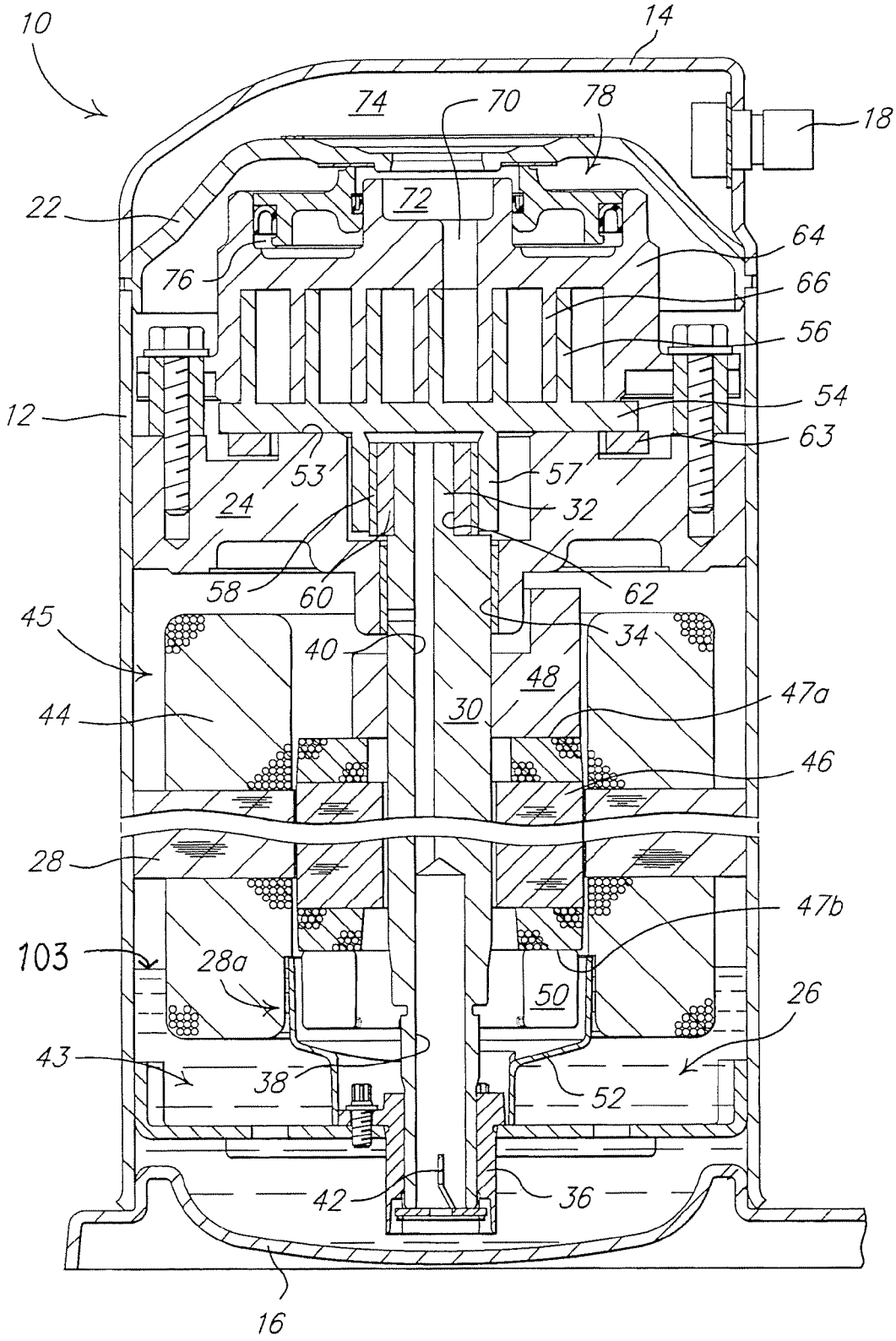
FIG. 1 is vertical section view of a refrigeration compressor incorporating a shield member in accordance with the present teachings.
Figure 2:
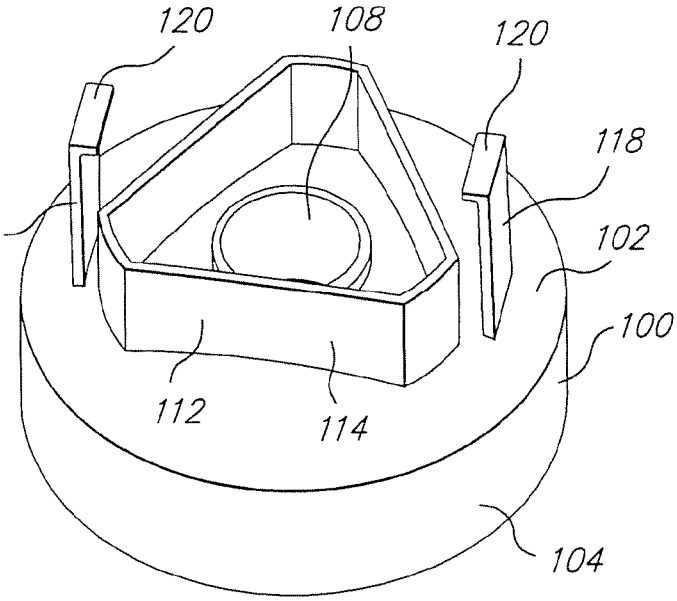
FIG. 2 is a perspective view showing the bottom side of the shield member utilized in the refrigeration compressor of FIG. 1.
Figure 3:
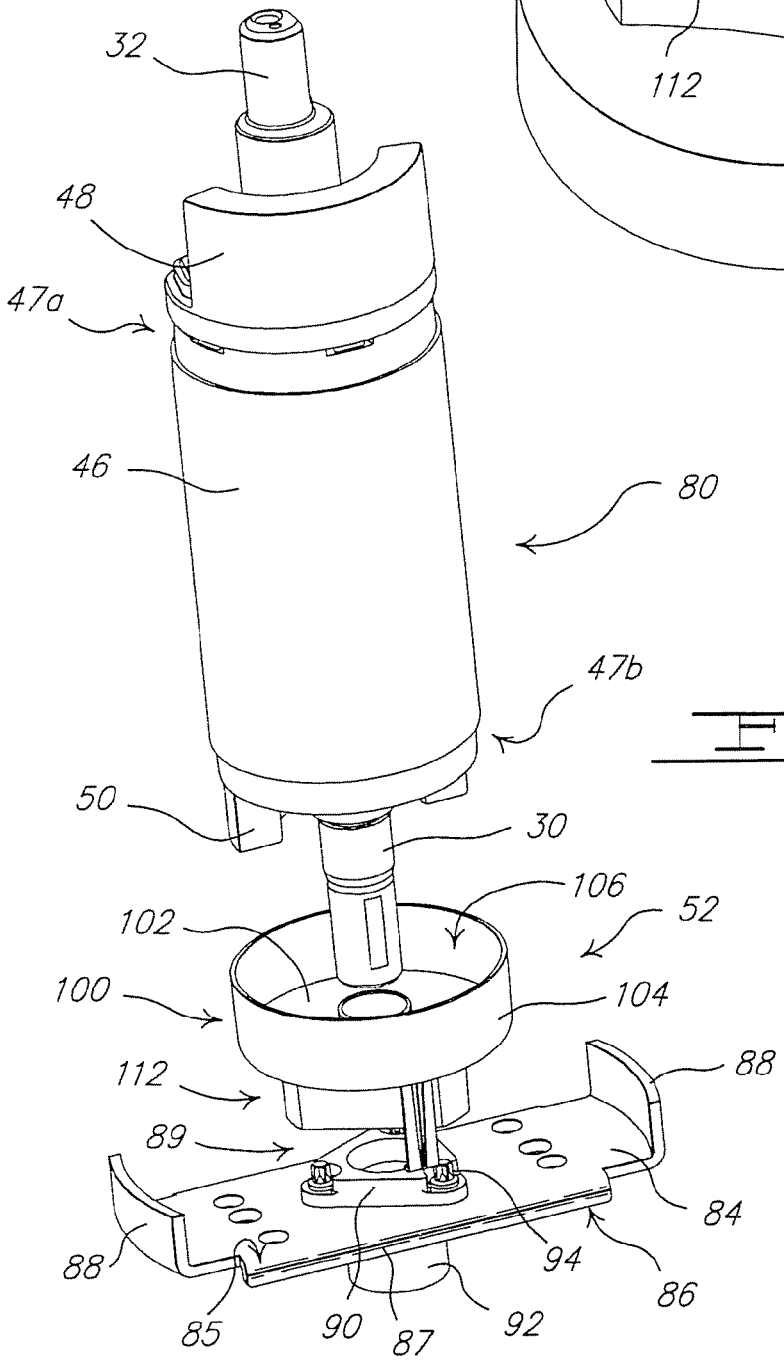
FIG. 3 is an exploded view of the rotor assembly, shield member and lower bearing assembly utilized in the refrigeration compressor of FIG. 1.
Figure 4:
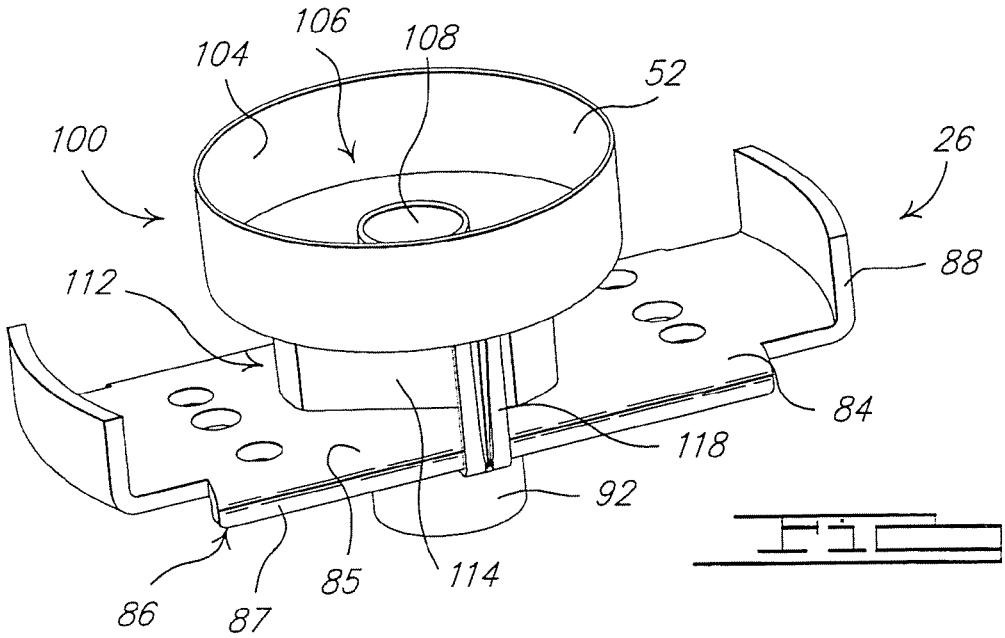
FIG. 4 is a perspective view of the shield member attached to the lower bearing assembly.

Referring now to the drawings and in particular to FIG. 1, a compressor 10 includes a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). A transversely extending partition 22 is welded about its periphery at the same point that cap 14 is welded to shell 12. A stationary main bearing housing or body 24 and a lower bearing assembly 26 are secured to shell 12. A motor stator 28, which is generally square in cross section but with the corners rounded off, is press-fit into shell 12. The flats between the rounded corners on the stator 28 provide passageways between stator 28 and shell 12, to facilitate the flow of lubricant within shell 12.

A drive shaft or crankshaft 30 having an eccentric crankpin 32 at the upper end thereof is rotatably journaled in a bearing 34 in main bearing housing 24 and a second bearing 36 in lower bearing assembly 26. Crankshaft 30 has at the lower end a relatively large diameter concentric bore 38 which communicates with a radially outwardly inclined smaller diameter bore 40 extending upwardly therefrom to the top of the crankshaft. Disposed within bore 38 is a stirrer 42. The lower portion of the interior shell 12 forms a sump 43 which is filled with lubricant, and bore 38 acts as a pump to pump lubricating fluid up the crankshaft 30 and into bore 40 and ultimately to various portions of the compressor that require lubrication.

Crankshaft 30 is rotatively driven by an electric motor 45 including stator 28, windings 44 passing therethrough and a rotor 46 having upper and lower surfaces 47*a*, 47*b* press-fit on the crankshaft 30 and having upper and lower counter weights 48 and 50 respectively. A counter-weight shield/cup 52 is provided to reduce the work loss caused by lower counter weight 50 spinning in the lubricant in sump 43.

The upper surface of main bearing housing 24 includes a flat thrust bearing surface 53 supporting an orbiting scroll 54, which includes a spiral vane or wrap 56 on an upper surface thereof. Projecting downwardly from the lower surface of orbiting scroll 54 is a cylindrical hub 57 having a journal bearing 58 therein. A drive bushing 60, which is rotatively disposed in hub 57, includes an inner bore 62 in which crankpin 32 is drivingly disposed. Crankpin 32 has a flat on one surface that drivingly engages a flat surface (not shown) formed in a portion of bore 62 to provide a radially compliant driving arrangement, such as shown in assignee's U.S. Pat. No. 4,877,382, entitled "Scroll-Type Machine with Axially Compliant Mounting," the disclosure of which is herein incorporated by reference. An Oldham coupling 63 is positioned between and keyed to orbiting scroll 54 and bearing housing 24 to prevent rotational movement of orbiting scroll 54. Oldham coupling 63 may be of the type disclosed in the above-referenced U.S. Pat. No. 4,877,382; however, other Oldham couplings, such as the coupling disclosed in assignee's U.S. Pat. No. 6,231,324, entitled "Oldham Coupling for Scroll Machine," the disclosure of which is hereby incorporated by reference, may also be used.

A non-orbiting scroll 64 includes a wrap 66 positioned in meshing engagement with wrap 56 of scroll 54. Non-orbiting scroll 64 has a centrally disposed discharge passage 70 communicating with an upwardly open recess 72 that is in fluid communication with a discharge muffler chamber 74 defined by cap 14 and partition 22. Non-orbiting scroll 64 includes an annular recess 76, in which is disposed a seal assembly 78. Recesses 72 and 76 and seal assembly 78 cooperate to define axial pressure biasing chambers that receive pressurized fluid being compressed by wraps 56 and 66 so as to exert an axial biasing force on non-orbiting scroll 64 and urge the tips of respective wraps 56, 66 into sealing engagement with the opposed end plate surfaces. Seal assembly 78 may be of the type described in assignee's U.S. Pat. Nos. 5,156,539 and RE 35,216, entitled "Scroll Machine with Floating Seal," the disclosures of which are hereby incorporated by reference.

Referring now to FIGS. 2-9, lower bearing assembly 26 includes a bearing plate 84 having upper and lower surfaces 85, 86 and a side edge 87 therebetween. Bearing plate 84 also has axially-extending legs 88 on opposite ends thereof, and is configured to extend across the interior of shell 12 with legs 88 engaged with and welded to the interior surface of shell 12 to hold bearing plate 84 in position. Bearing plate 84 may be made from a variety of material, such as stamped metal.

A bearing hub 89 is centrally disposed within bearing plate 84, and includes an opening through which crankshaft 30 extends. Bearing hub 89 has an upwardly projecting portion 90 having a generally triangular periphery, and has a lower projecting portion 92 that has a generally circular periphery. Bearing hub 89 is rotationally and axially fixed to bearing plate 84 with a plurality of fasteners 94.

Shield 52 includes an upper portion 100 that is generally formed in the shape of a cup with a generally circular periphery, a lower portion 112 that is generally in the shape of a cup with a generally triangular periphery, and a pair of finger members 118. Shield 52 can be made from a variety of materials that are compatible with the chosen refrigerant and lubricant utilized in compressor 10. Shield 52 is preferably formed as a one-piece structure from a suitable polymeric composition such as a nylon material for example. It should be noted that other materials may be utilized so long as they are able to resist degradation from both the lubricant and refrigerant utilized in the system as well as the heat generated during operation of compressor 10. It should also be noted that the use of a dielectric non-magnetic material is believed preferable due to the proximity of the shield to the motor rotor and stator and the desire to avoid any interference with the operation thereof.

Upper portion 100 has a radially extending bottom surface or section 102 with an axially extending sidewall or section 104 axially extending from the outer periphery of bottom surface 102 to form an interior volume 106 of upper portion 100. A central opening 108 extends through the center of bottom surface 102. Shield 52 also includes a lower portion 112 that extends downwardly from bottom 102 of upper portion 100.

Lower portion 112 has a generally triangular inner and outer periphery with blunted corners and formed by a sidewall section 114 that extends axially downwardly from bottom 102. Lower portion 112 is centered around opening 108.

Finger members 118 each include a radially inwardly extending pawl or projection 120 on an end thereof extending radially downwardly from bottom 102 toward opening 108 and are spaced radially outwardly from sidewall 114 of lower portion 112. Finger members 118 are resilient and capable of deforming to allow attachment of shield 52 to lower bearing assembly 26.

Referring now to FIGS. 4-9, the interconnections between shield 52, lower bearing assembly 26 and rotor assembly 80 are shown. Shield 52 is configured to be releasably attached to lower bearing assembly 26. Specifically, shield 52 is positioned on lower bearing assembly 26 with sidewall 114 of lower portion 112 surrounding upper portion 90 of bearing hub 89. The triangular interior periphery of lower portion 112 is complementary to the triangular outer periphery of upper portion 90. The engagement between lower portion 112 of shield 52 with upper portion 90 of bearing hub 89 limits the ability of shield 52 to rotate relative to bearing hub 89. The dimensions of upper portion 90 of bearing hub 89 and of lower portion 112 of shield 52 can be configured to allow limited relative rotation therebetween or to prevent rotation therebetween. With bearing hub 89 rotationally fixed to bearing plate 84, rotation of shield 52 relative to lower bearing assembly 26 and shell 12 can be limited and/or prevented. While the complementary interior and exterior peripheries of lower portion 112 of shield 52 and upper portion 90 of bearing hub 89 are shown as being generally triangular, it should be appreciated that other complementary geometric configurations can be employed. Additionally, it should be appreciated that other engagement features, such as through the use of projections and recesses can be employed to limit and/or prevent the relative rotation between shield 52 and lower bearing assembly 26.

The axial length of sidewall 114 and finger members 118 are configured to axially restrain shield 52 on lower bearing assembly 26 when attached thereto. Specifically, finger members 118 are configured to extend beyond side edge 87 of bearing plate 84 so that pawls 120 engage with the lower surface of side edge 87 or lower surface 86 of bearing plate 84 when sidewall 114 encounters upper surface 85 of bearing plate 84. The resiliency of finger members 118 allows finger members 118 to deform outwardly as shield 52 is being positioned on lower bearing assembly 26 and for pawls 120 to engage with the lower surface. The engagement between pawls 120 and the lower surface and the engagement between sidewall 114 and upper surface 85 limits the ability of shield 52 to move axially relative to bearing plate 84 and, by extension, lower bearing assembly 26 and shell 12. The axial length of sidewalls 114 and finger members 118 can be configured to allow some or limited relative axial movement or to prevent any axial movement therebetween, as desired.

Figure 5:
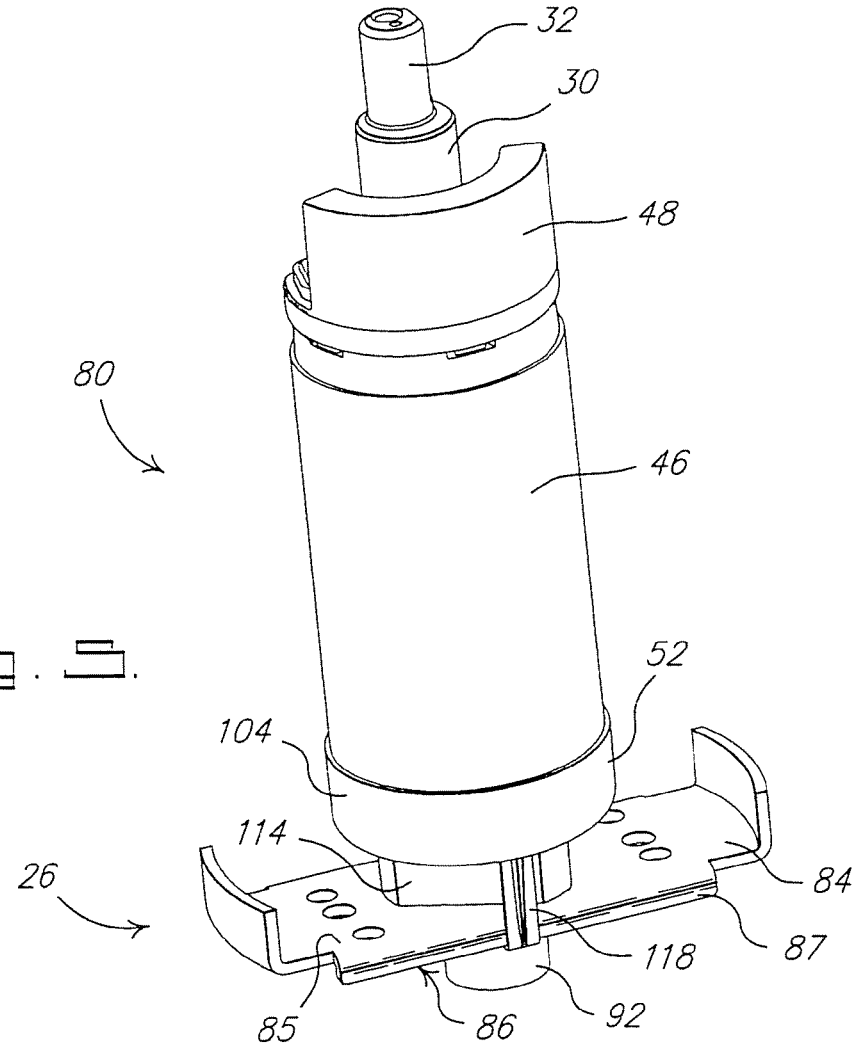
FIG. 5 is a perspective view of a rotor assembly, shield member and lower bearing assembly assembled together wherein the shield member surrounds the lower end and a portion of the outer peripheral surface of the rotor.
Figure 6:
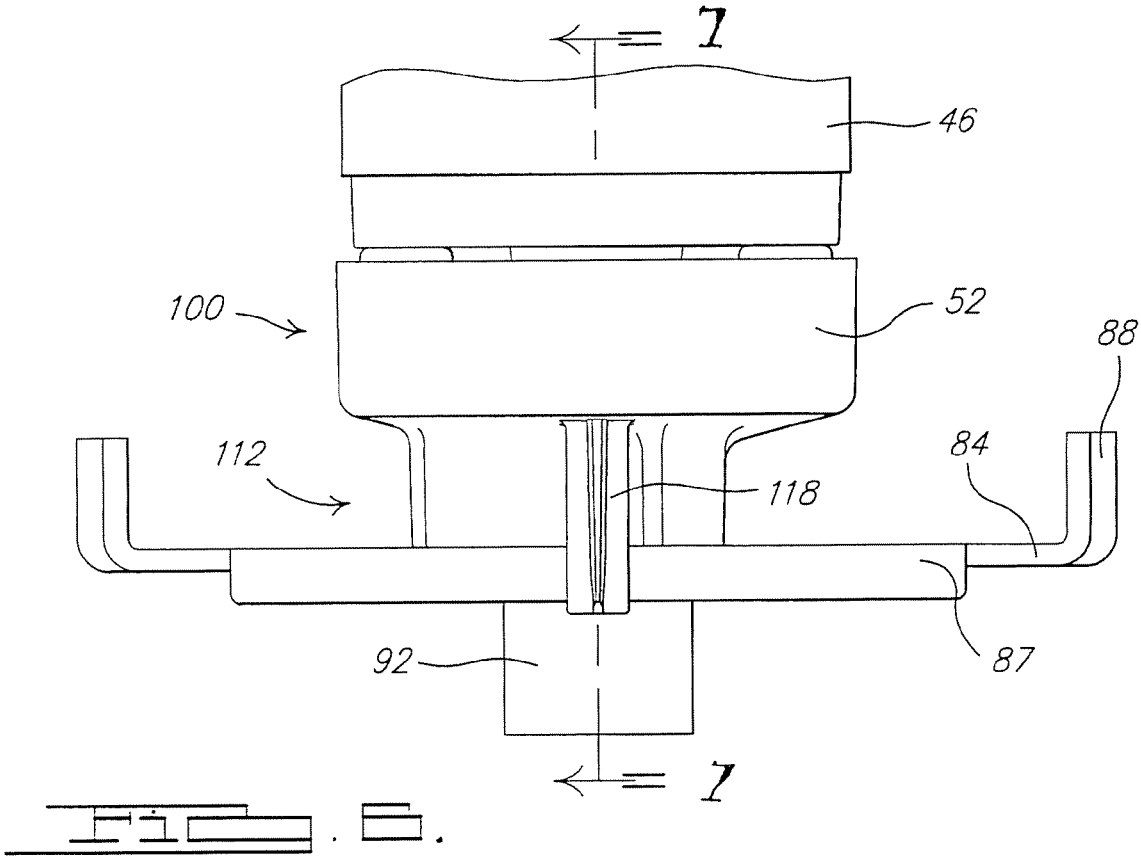
FIG. 6 is an enlarged fragmented side elevation view of the rotor assembly, shield member and lower bearing assembly of FIG. 4.
Figure 7:
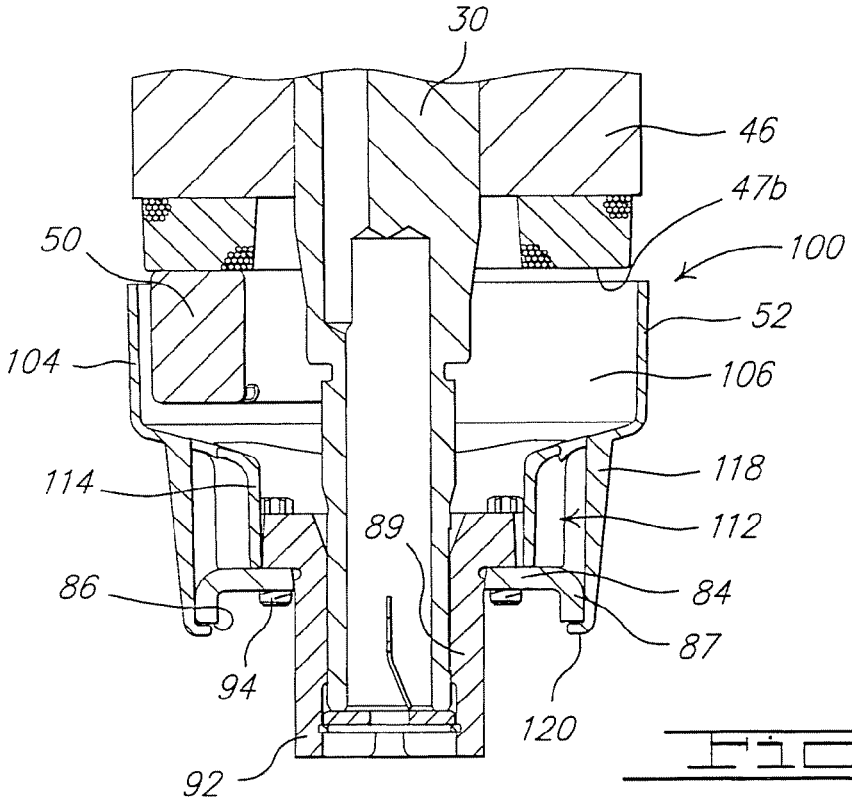
FIG. 7 is a cross-sectional view along line 7-7 of FIG. 6.
Figure 8:
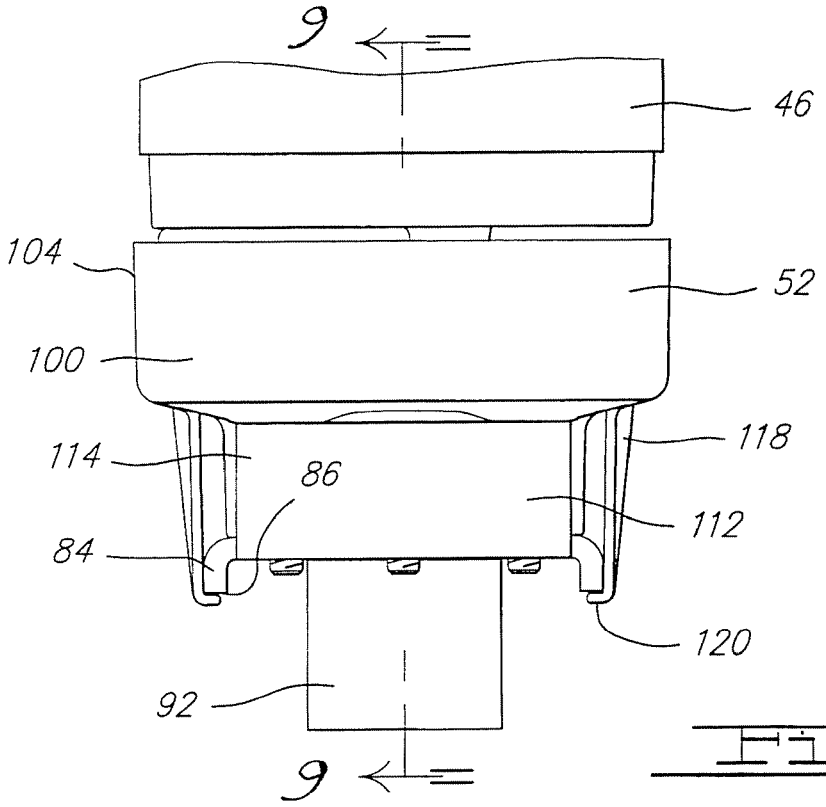
FIG. 8 is a different enlarged fragmented side elevation view of the rotor assembly, shield member and lower bearing assembly of FIG. 4.
Figure 9:
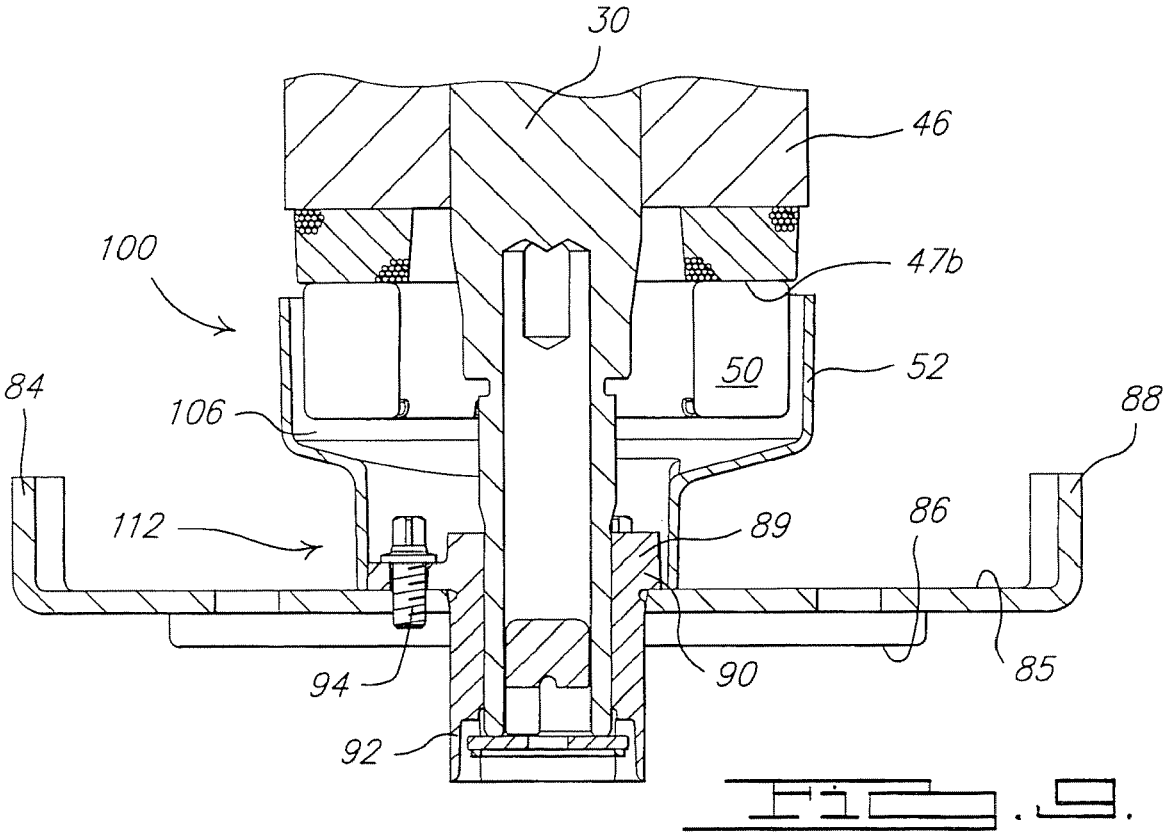
FIG. 9 is a cross-sectional view along line 9-9 of FIG. 8.

With shield 52 secured to lower bearing assembly 26, lower bearing assembly 26 can be positioned within shell 12 with crankshaft 30 passing through opening 108 in shield 52 and through bearing hub 89. Shield 52 is configured to form a close fit between opening 108 and crankshaft 30. Upper portion 100 of shield 52 surrounds lower end 47*b* of rotor 46 with sidewall 104 of upper portion 100 extending axially upwardly over at least a portion of lower counter weight 50 in the annular space between lower counter weight 50 and windings 44 of stator 28. Sidewall 104 can have an axial length that causes sidewall 104 to extend axially upwardly the entire axial length of lower counter weight 50 and surround the lower end 47*b* of rotor 46 in addition to lower counter weight 50, as shown in FIG. 5. Optionally, sidewall 104 can extend axially upwardly beyond lower end 47*b* and surround a portion of the outer peripheral surface of rotor 46, as shown in FIG. 5. Sidewall 104 is dimensioned to extend above a normal upper non-operating level 103 of the lubricant with compressor 10, as shown in FIG. 1. The normal upper non-operating level 103 of the lubricant within compressor 10 is defined as the level at which the lubricant resides within compressor 10 when rotor 46 and crankshaft 30 are not rotating.

During operation, the rotational movement of counter weight 50 and lower end 47*b* of rotor 46 will operate to throw lubricant that has accumulated within interior volume 106 of shield 52 radially outwardly and over the top edge of sidewall 104, through the open spaces in the stator end turns 28*a*, as well as between shield 52 and these end turns 28*a*, and into sump 43, thereby lowering the lubricant level in the area surrounding the rotating rotor. Because the opening 108 of shield 52 is closely fitted to crankshaft 30, only a small amount of lubricant will flow upwardly therebetween. That is, the rate of lubricant entering interior volume 106 will be less than the rate at which the lubricant is thrown radially outwardly and over sidewall 104. When compressor 10 is de-energized, lubricant gradually flows back into interior volume 106 of shield 52.

Depending on the amount of relative axial movement allowed between shield 52 and lower bearing assembly 26, shield 52 may become buoyant and float upwardly in the lubricant sump 43. The limited axial movement, however, prevents shield 52 from moving upwardly into engagement with spinning rotor 46 and/or counter weight 50. Thus, shield 52 will reduce the drag on rotation of counter weight 50 and rotor 46 due to its partial immersion into the lubricant within the lubricant sump 43, thereby eliminating the resulting power consumption that would occur if the drag were not reduced. In this regard, the clearance between opening 108 and crankshaft 30 should be sufficient to avoid any excessive wear or drag on shield 52 but yet tight enough to enable crankshaft 30 to effectively maintain shield 52 at a substantially coaxially position with respect to rotor 46 and minimize potential contact therebetween.

Figure 10:
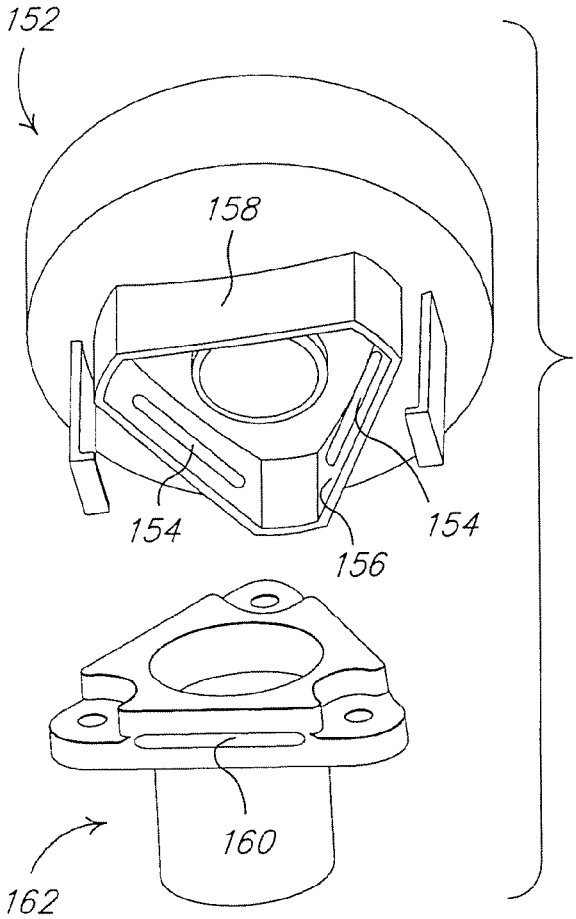
FIG. 10 is a perspective view of a shield member and bearing hub according to the present teachings.

Referring now to FIG. 10, a shield 152 employs a different configuration to limit the relative axial movement between shield 152 and the lower bearing assembly 26. Specifically, in lieu of fingers having pawls thereon, a plurality of radially inwardly extending projections 154 are disposed on sidewall 156 of lower portion 158. Additionally, a plurality of complementary recesses 160 extend radially inwardly along the outer surface of bearing hub 162. When shield 152 is positioned on the lower bearing assembly 26, projections 154 engage with recesses 160 to limit the axial movement of shield 152 relative to bearing hub 162 and, consequently, the lower bearing assembly 26. The projections 154 may take a variety of forms other than that shown. For example, projections 154 could be a plurality of rounded nubs, ribs, or other types of projections with bearing hub 162 having a plurality of complementary recesses that engage therewith. If desired, the projections and recesses can be reversed (e.g., recesses on shield 152 and projections on bearing hub 162) to limit relative axial movement.

Figure 11:
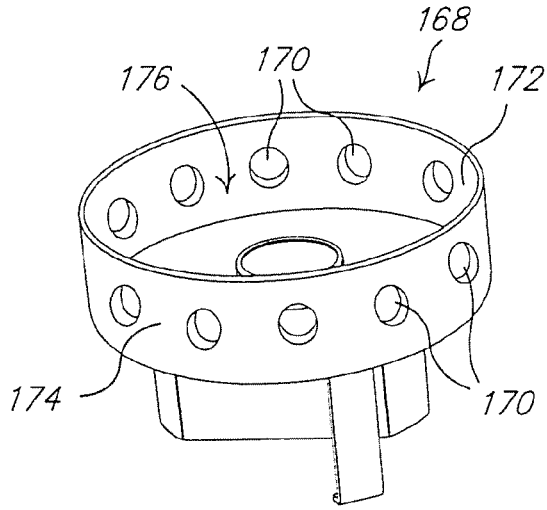
FIG. 11 is a perspective view of a shield member according to the present teachings.
Figure 13:
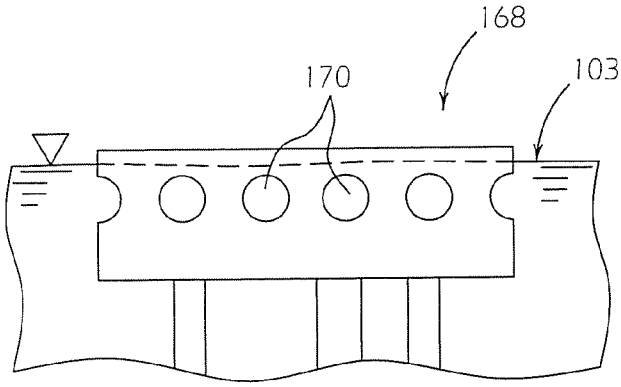
FIG. 13 is a plan view of the shield member of FIG. 11 showing the normal upper non-operating lubricant level positioned above the openings therein.
Figure 14:
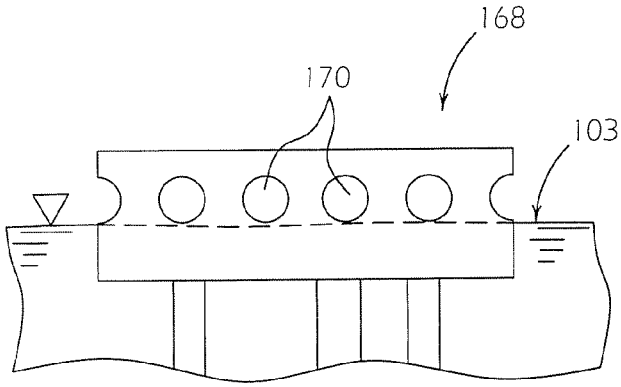
FIG. 14 is a plan view of the shield member of FIG. 11 showing the normal upper non-operating lubricant level at the openings therein.
Figure 15:
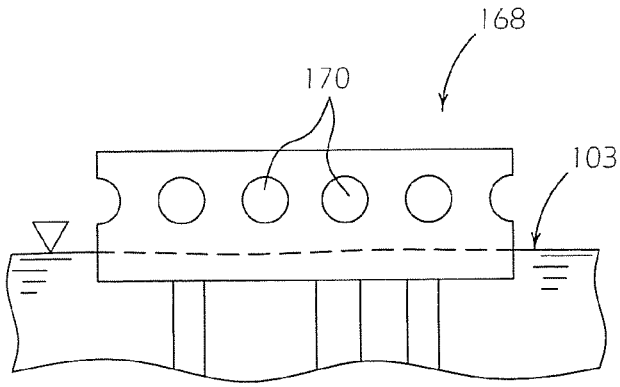
FIG. 15 is a plan view of the shield member of FIG. 11 showing the normal upper non-operating lubricant level at the openings therein.

Referring now to FIG. 11, another shield 168 is shown with a plurality of openings 170 provided in sidewall 172 of the upper portion 174. Openings 170 communicate with interior volume 176 of upper portion 174. Openings 170 can be positioned to be disposed at an axial position that is above, (as shown in FIG. 13), at (as shown in FIG. 14), or below (as shown in FIG. 15), the normal non-operating level 103 of lubricant within compressor 10. Openings 170 facilitate the removal of the lubricant from interior volume 176 when the compressor is energized and operating. That is, openings 170 provide additional flow paths for the lubricant being thrown by the rotation of the lower counter weight 50 and the rotor 46 such that the lubricant in addition to flowing over the top edge of sidewall 172 can also flow through openings 170.

Figure 12:
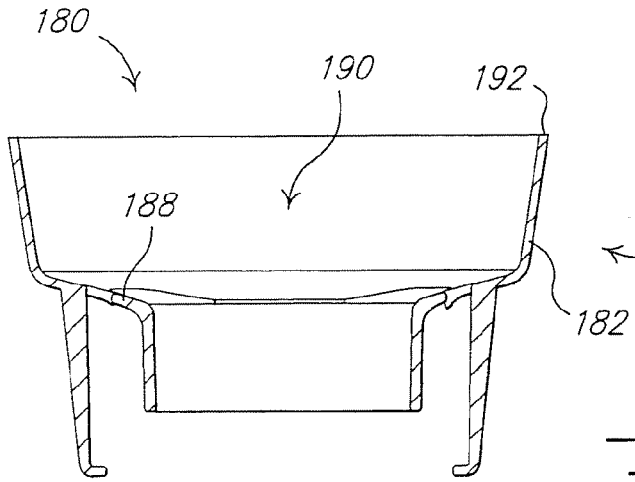
FIG. 12 is a cross-sectional view of a shield member according to the principles of the present teachings.

Referring now to FIG. 12, another shield 180 is shown in which sidewall 182 of upper portion 184 of shield 180 tapers radially outwardly as it extends axially upwardly from bottom surface 188. The amount of outward tapering of sidewall 182 is limited by the annular space between lower counter weight 50 and/or rotor 46 and windings 44 of stator 28. The tapering of sidewall 182 facilitates the removal of lubricant from the interior volume 190 of upper portion 184, and facilitates the lubricant being thrown by rotation of counter weight 50 and rotor 46 to ride up along sidewall 182 and over top edge 192 thereof.

While the present teachings have been described with reference to specific examples, it should be appreciated that variations that do not depart from the gist of the teachings may be utilized without departing from the spirit and scope of the present teachings. For example, the teachings disclosed can be combined in various combinations, as desired, to provide a desired shield. Furthermore, while specific examples are shown for the engagement between the shield and the lower bearing assembly to limit axial and/or rotational movement relative thereto, it should be appreciated that other types of engagements can be employed. For example, the finger members can extend through complementary openings within the bearing plate with the pawls engaging with the lower surface of the openings instead of the fingers extending around the side edge of the plate. Additionally, it should be appreciated that the bearing plate could be provided with axially upwardly extending finger members that will engage with a complementary feature of the shield. Moreover, it should be appreciated that the relative dimensions shown in the drawings are for exemplary purposes only and that deviations in the absolute and relative dimensions shown can be employed. Thus, the preceding description is merely exemplary in nature and variations are intended to be within the scope of the teachings.

What is claimed is:

1. A refrigeration compressor comprising:

a shell;

a sump disposed in a bottom of said shell;

a compression member within said shell;

a shaft within said shell drivingly connected to said compression member;

a motor disposed within said shell for driving said shaft, said shaft extending downwardly from said motor;

a shield member disposed around said shaft, including a first portion having an axially upwardly extending sidewall and surrounding a lower portion of said motor, and being secured relative to said shell to limit axial movement of said shield member relative thereto; and a bearing assembly disposed below said shield member and through which said shaft axially extends, wherein said shield member is engaged with said bearing assembly such that axial movement of said shield member relative to said shell in both axial directions along said shaft is limited by said engagement with said bearing assembly, a second portion of said shield member extends downwardly from said first portion and engages with said bearing assembly, and said second portion includes a plurality of downwardly extending fingers each having a pawl extending therefrom that engages with said bearing assembly to limit relative axial movement.

2. The refrigeration compressor of claim 1, wherein said bearing assembly includes a bearing hub attached to a support plate and said fingers engage with said support plate.

3. The refrigeration compressor of claim 1, wherein said bearing assembly includes a bearing hub attached to and extending upwardly from a support plate and said second portion of said shield member engages with said bearing hub to limit relative axial movement.

4. The refrigeration compressor of claim 1, wherein said bearing assembly includes an upwardly extending bearing hub, said second portion includes a downwardly extending hub that surrounds said bearing hub and engagement between said bearing hub and said second portion hub limits relative rotation between said shield member and said bearing hub.

5. The refrigeration compressor of claim 1, wherein said engagement between said shield member and said bearing assembly prevents relative axial movement between said shield member and said bearing assembly.

6. The refrigeration compressor of claim 1, further comprising a counter weight coupled to said lower portion of said motor and wherein said first portion surrounds said counter weight.

7. The refrigeration compressor of claim 1, wherein said motor includes a stator and a rotor secured to said shaft, a lower end of said rotor being rotatable and extending below a normal upper non-operating lubricant level of said sump, said shaft extends downwardly from said lower end of said rotor, said shield member extends above said normal upper non-operating lubricant level of said sump, said first portion sidewall surrounds said lower end of said rotor, and said shield member restricts lubricant flow to said rotating lower end of said rotor during operation of the compressor.

8. A refrigeration compressor comprising:

a shell;

a sump disposed in a bottom of said shell;

a compression member within said shell;

a shaft within said shell drivingly connected to said compression member;

a motor disposed within said shell for driving said shaft, said motor including a stator, a rotor and at least one weight coupled to said rotor, said shaft extending downwardly from said motor;

a bearing assembly through which said shaft extends; and a shield member disposed around said shaft, including a first portion surrounding a portion of at least one of said rotor and said counter weight and a second portion engaged with said bearing assembly such that rotational movement of said shield member relative to said shell is limited by said engagement, wherein said bearing assembly includes an axially upwardly extending bearing hub, said second portion of said shield member extends axially downwardly and is complementary to and radially surrounds a portion of said bearing hub, and said second portion is engaged with said bearing hub such that rotational movement of said shield member relative to said shell is limited by said engagement.

9. The refrigeration compressor of claim 8, wherein said shield member includes a third portion engaged with said bearing assembly such that axial movement of said shield member relative to said bearing assembly is limited by said engagement of said third portion.

10. The refrigeration compressor of claim 9, wherein said third portion includes a plurality of axially extending fingers each having a pawl that engages with said bearing assembly to limit relative axial movement therebetween.

11. The refrigeration compressor of claim 9, wherein said engagement between said third portion and said bearing assembly prevents relative axial movement therebetween.

12. The refrigeration compressor of claim 8, wherein said bearing hub has a substantially triangular outer periphery and said second portion of said shield member has an interior periphery that is complementary to said bearing hub outer periphery.

13. The refrigeration compressor of claim 8, wherein said engagement between said shield member and said bearing assembly prevents relative rotation between said shield member and said shell.

14. The refrigeration compressor of claim 8, wherein said engagement between said shield member and said bearing assembly limits axial movement of said shield member relative to said bearing assembly.

15. The refrigeration compressor of claim 8, further comprising a counter weight coupled to said motor and wherein said first portion surrounds said counter weight.

16. The refrigeration compressor of claim 8, wherein a lower end of said rotor is rotatable and extends below a normal upper non-operating lubricant level of said sump, said shaft extends downwardly from said lower end of said rotor, said first portion of said shield member includes an axially upwardly extending sidewall that extends above said normal upper non-operating lubricant level of said sump, said first portion sidewall surrounds said lower end of said rotor, and said shield member restricts lubricant flow to said rotating lower end of said rotor during operation of the compressor.

17. The refrigeration compressor of claim 8, wherein said bearing hub has a first engaging surface, said second portion has a second engaging surface complementary to said first engaging surface and engagement of said first and second engaging surfaces limits relative rotation therebetween.

18. A refrigeration compressor comprising:

an outer shell;

a sump disposed in a bottom of said shell;

a compression member within said shell;

a shaft within said shell drivingly engaged with said compression member;

a motor disposed within said shell for driving said shaft, said shaft extending downwardly from said motor; and a shield member disposed around said shaft, including a first portion having an axially upwardly extending sidewall extending from a bottom shield portion and surrounding a lower portion of said motor and an integral engagement feature, wherein both axial upward movement and rotational movement of said shield member relative to said shell is limited by engagement of said shield member engagement feature with at least one component of the compressor other than said shaft and said engagement feature includes an axially extending finger extending downwardly from said bottom shield portion and having a radially extending pawl.

19. The refrigeration compressor of claim 18, further comprising a bearing assembly through which said shaft extends and wherein said shield member is engaged with said bearing assembly such that axial movement of said shield member relative to said bearing assembly is limited by said engagement.

20. The refrigeration compressor of claim 18, further comprising a bearing assembly through which said shaft extends and wherein said shield member is engaged with said bearing assembly such that rotational movement of said shield member relative to said bearing assembly is limited by said engagement.

21. The refrigeration compressor of claim 18, wherein said motor includes a stator and a rotor secured to said shaft, a lower end of said rotor being rotatable and extending below a normal upper non-operating lubricant level of said sump, said shaft extends downwardly from said lower end of said rotor, said sidewall extends above said normal upper non-operating lubricant level of said sump, said sidewall surrounds said lower end of said rotor, and said shield member restricts lubricant flow to said rotating lower end of said rotor during operation of the compressor.

22. The refrigeration compressor of claim 18, wherein said engagement feature includes an axially extending hub.

23. A refrigeration compressor comprising:

an outer shell;

a sump disposed in a bottom of said shell;

a compression member within said shell;

a shaft within said shell drivingly engaged with said compression member;

a motor disposed within said shell for driving said shaft, said shaft extending downwardly from said motor; and a shield member disposed around said shaft, including a first portion having an axially upwardly extending sidewall surrounding a lower portion of said motor, wherein said first portion includes a radially extending section and said sidewall extends upwardly from an outer periphery of said radially extending section and said sidewall has a plurality of radially extending openings therein through which lubricant can flow and said openings are positioned above a normal upper non-operating lubricant level of said sump.

24. A refrigeration compressor comprising:

a shell;

a sump disposed in a bottom of said shell;

a compression member within said shell;

a shaft within said shell drivingly connected to said compression member;

a motor disposed within said shell for driving said shaft, said motor including a stator, a rotor and at least one counter weight coupled to said rotor, said shaft extending downwardly from said motor;

a bearing assembly through which said shaft extends; and a shield member disposed around said shaft, including a first portion surrounding a portion of at least one of said rotor and said counter weight and a second portion engaged with said bearing assembly such that rotational movement of said shield member relative to said shell is limited by said engagement, wherein said bearing assembly includes an axially upwardly extending bearing hub, said second portion of said shield member extends axially downwardly and is complementary to and radially surrounds a portion of said bearing hub, and said second portion is engaged with said bearing hub such that rotational movement of said shield member relative to said shell is limited by said engagement, and said shield member is a single integral member.

* * * * *